US011745063B2

(12) United States Patent
Huang et al.

(10) Patent No.: US 11,745,063 B2
(45) Date of Patent: Sep. 5, 2023

(54) FORGED IRON HEAD

(71) Applicant: Karsten Manufacturing Corporation, Phoenix, AZ (US)

(72) Inventors: Yujen Huang, Pingtung (TW); Erik M. Henrikson, Phoenix, AZ (US); Matthew W. Simone, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/652,063

(22) Filed: Feb. 22, 2022

(65) Prior Publication Data

US 2022/0176210 A1 Jun. 9, 2022

Related U.S. Application Data

(63) Continuation of application No. 16/858,520, filed on Apr. 24, 2020, now Pat. No. 11,253,758.

(60) Provisional application No. 62/839,411, filed on Apr. 26, 2019.

(51) Int. Cl.
*A63B 53/04* (2015.01)
*A63B 53/08* (2015.01)

(52) U.S. Cl.
CPC ..... *A63B 53/047* (2013.01); *A63B 53/08* (2013.01); *A63B 53/0412* (2020.08); *A63B 2053/0491* (2013.01); *A63B 2209/10* (2013.01)

(58) Field of Classification Search
CPC ..... A63B 53/047; A63B 2053/0491
USPC ..... 473/334, 336
See application file for complete search history.

(56) References Cited

U.S. PATENT DOCUMENTS

| | | | | |
|---|---|---|---|---|
| 3,979,122 | A | 9/1976 | Belmont | |
| 6,200,228 | B1 | 3/2001 | Takeda | |
| 7,040,000 | B2 | 5/2006 | Takeda | |
| 7,815,523 | B2 | 10/2010 | Knutson et al. | |
| 7,980,960 | B2 | 7/2011 | Gilbert et al. | |
| 8,206,237 | B2 | 6/2012 | Gilbert et al. | |
| 8,376,878 | B2 | 2/2013 | Bennett et al. | |
| 8,926,451 | B2 | 1/2015 | Deshmukh et al. | |
| 9,895,584 | B1 | 2/2018 | Su | |
| 10,398,951 | B2 * | 9/2019 | Golden | A63B 53/0475 |
| 10,420,991 | B2 | 9/2019 | Petersen et al. | |
| 2002/0095762 | A1 | 7/2002 | Takeda | |
| 2012/0157223 | A1 * | 6/2012 | Finn | A63B 53/047 473/291 |
| 2016/0008871 | A1 | 1/2016 | Su | |
| 2017/0274253 | A1 * | 9/2017 | Stokke | A63B 60/52 |

* cited by examiner

*Primary Examiner* — Raeann Gorden

(57) ABSTRACT

The invention described herein is an iron-type golf club head having an optimized mass distribution while also having the aesthetics of a full muscle-back iron. The iron-type golf club head comprises a main club head body, a lightweight, back-cavity insert, and a void within the lightweight, back-cavity insert configured to receive a CTP weight capable of adjusting mass characteristics of the iron-type golf club head.

18 Claims, 10 Drawing Sheets

FORGED IRON HEAD

CROSS-REFERENCE TO RELATED APPLICATIONS

This is a continuation of U.S. patent application Ser. No. 16/858,520 filed Apr. 24, 2020, which claims the benefit of U.S. Provisional Patent Application No. 62/839,411 filed Apr. 26, 2019, the contents of which are fully incorporated herein by reference.

TECHNICAL FIELD

This disclosure generally relates to a golf club head with a 3D forged, lightweight component in the back cavity.

BACKGROUND

There is a need in the art for an iron-type golf club head having improved mass distribution for inertial improvement, while also maintaining the aesthetics of a full muscle-back iron.

The invention described herein is an iron-type golf club head having an optimized mass distribution while also having the aesthetics of a full muscle-back iron. The iron-type golf club head comprises a main club head body, a lightweight, back-cavity insert, and a void within the lightweight, back-cavity insert configured to receive a CTP weight capable of adjusting mass characteristics of the iron-type golf club head.

BRIEF DESCRIPTION OF THE DRAWINGS

This disclosure generally relates to sports equipment and relates more particularly to golf club heads and related methods.

FIGS. 1-9 refer to a single embodiment of an iron-type golf club head.

Figure 1:
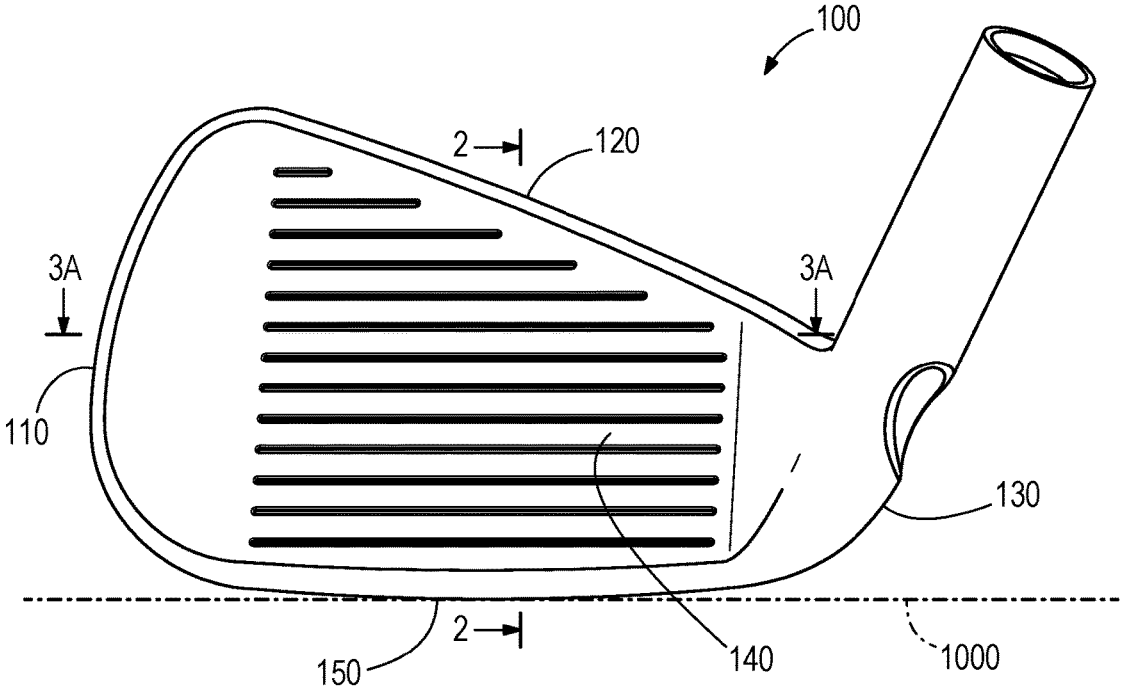
FIG. 1 illustrates an iron-type golf club head front view at address relative to a ground plane.

Other aspects of the disclosure will become apparent by consideration of the detailed description and accompanying drawings.

DETAILED DESCRIPTION

The iron-type golf club described herein provides both the visual aesthetic of a traditional muscle-back iron-type golf club head, the mass properties of more forgiving cavity back iron-type golf club heads, and the ability to adjust club head center of gravity provided by a detachable CTP weight. The iron-type golf club head comprises a back cavity, which allows more mass to be moved to the perimeter of the golf club head. A lightweight back cavity component or lightweight component is attached within the back cavity. The golf club head further comprises a CTP weight received with a void in the lightweight component allowing for the change of mass properties by configuring the mass of the CTP weight.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

The aspects of the golf club described herein may be applied to one or more golf clubs within a set of irons. In some embodiments, the set of irons comprises irons having varying clubhead size, shaft length, lie angle, loft angle, head weight, and/or other parameters. Each clubhead in the set of irons can be numbered according to the convention with numbers ranging from 1 to 10. Most commonly, a set is numbered from 2 to 9, wedge, and utility clubs. Furthermore, the set of irons can comprise one or more wedges, which have a loft angle higher than the numbered irons.

In some embodiments, the golf club head 100 can be a wedge. In many embodiments, the loft angle of the golf club head 100 is less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the golf club head 100 is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In many embodiments, the loft angle of the golf club head is less than approximately 64 degrees, less than approximately 63 degrees, less than approximately 62 degrees, less than approximately 61 degrees, less than approximately 60 degrees, less than approximately 59 degrees, less than approximately 58 degrees, less than approximately 57 degrees, less than approximately 56 degrees, less than approximately 55 degrees, or less than approximately 54 degrees. Further, in many embodiments, the loft angle of the golf club head is greater than approximately 46 degrees, greater than approximately 47 degrees, greater than approximately 48 degrees, greater than approximately 49 degrees, greater than approximately 50 degrees, greater than approximately 51 degrees, or greater than approximately 52 degrees.

In many embodiments, the golf club head can comprise a total volume of between 1.9 cubic inches and 2.7 cubic inches. In some embodiments, the total volume of the golf club head can be between 1.9 cubic inches and 2.4 cubic inches, 2.0 cubic inches and 2.5 cubic inches, 2.1 cubic inches and 2.6 cubic inches, 2.2 cubic inches and 2.7 cubic inches, 2.3 cubic inches and 2.7 cubic inches, or 2.4 cubic inches and 2.7 cubic inches. In other embodiments, the total volume of the golf club head can be 1.9 cubic inches, 2.0 cubic inches, 2.1 cubic inches, 2.2 cubic inches, 2.3 cubic inches, 2.4 cubic inches, 2.5 cubic inches, 2.6 cubic inches, or 2.7 cubic inches.

In many embodiments, the golf club head can comprise a total mass of between 200 grams and 300 grams. In some embodiments, the golf club head can comprise a total mass of between 200 grams and 210 grams, 210 grams and 220 grams, 220 grams and 230 grams, 230 grams and 240 grams, 240 grams and 250 grams, 250 grams and 260 grams, 255 grams and 260 grams, 260 grams to 270 grams, 265 grams to 275 grams, 270 grams and 280 grams, 275 grams, and 280 grams, or 250 grams and 270 grams. In other embodiments, the total mass can be 200 grams, 205 grams, 210 grams, 220 grams, 225 grams, 230 grams, 235 grams, 240 grams, 245 grams, 250 grams, 255 grams, 260 grams, 265 grams, 270 grams, 275 grams, 280 grams, 285 grams, 290 grams, 295 grams, or 300 grams.

Golf Club Head Main Body

The iron-type golf club head comprises a main body having a back cavity, which allows more mass to be moved to the perimeter of the golf club head. A lightweight back cavity component or lightweight insert is attached within the back cavity. The golf club head further comprises a CTP weight received with a void in the lightweight component allowing for the change of mass properties by configuring the mass of the CTP weight to move the center of gravity of the golf club head toward the toe or toward the heel.

Figure 2:
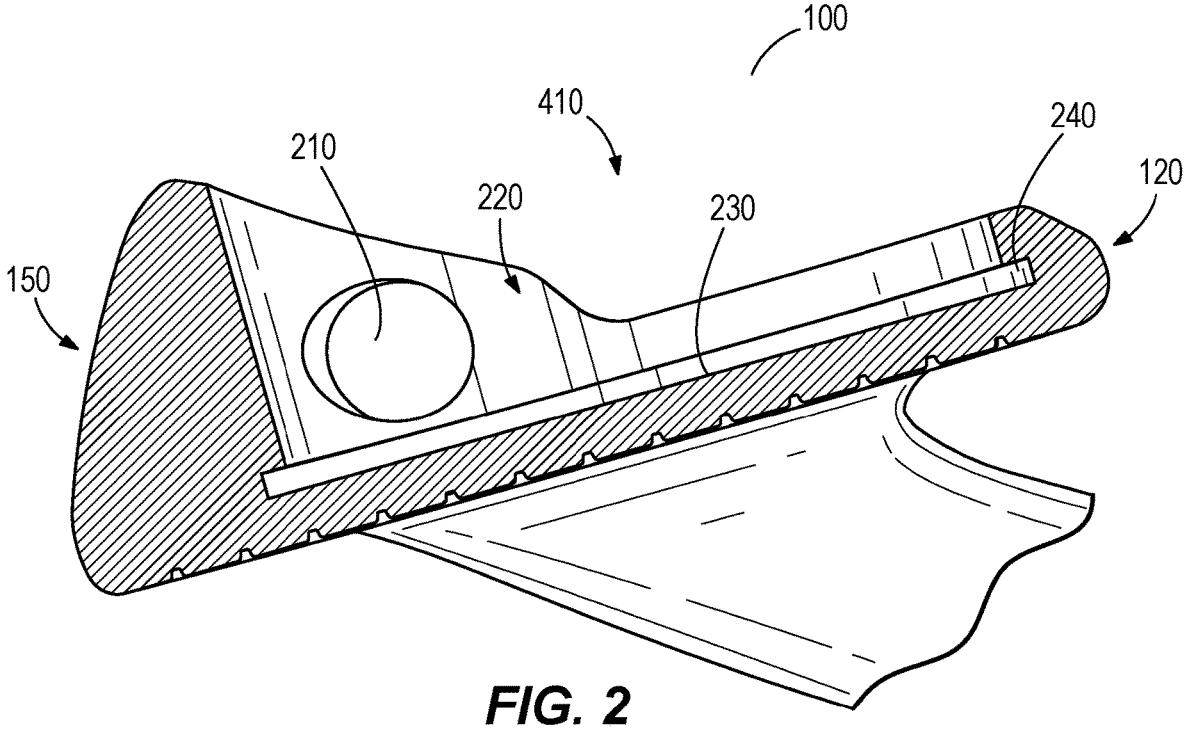
FIG. 2 illustrates a cross-section of the iron-type golf club head with a back cavity and aperture through the heel end.

Referring to FIGS. 1 and 2, the main body 410 of the iron-type golf club head 100 has a toe end 110, a heel end, a front having a strikeface 140 for impacting a golf ball, a hosel, a top-rail 120, a sole, a hosel configured for receiving a shaft, a rear opposite the front, and a back cavity 220 surrounded and defined by a rear surface 230 of the striking face 140, and a perimeter sidewall 460 surrounding the back cavity 220 formed by the top-rail 120, the sole 150, the toe end 110, and the heel end 130. The main body 410 sole 150 extends toward the rear of the main body 410 further than the top-rail 120. Thus, the lower portions of the perimeter sidewall 460 extend further to the rear than the upper portions of the perimeter sidewall 460. The back cavity 220 comprises a depth, and the back cavity 220 depth is greater in a lower, soleward portion than in the upper, top-rail 120 portion of the back cavity 220.

Figure 3A:
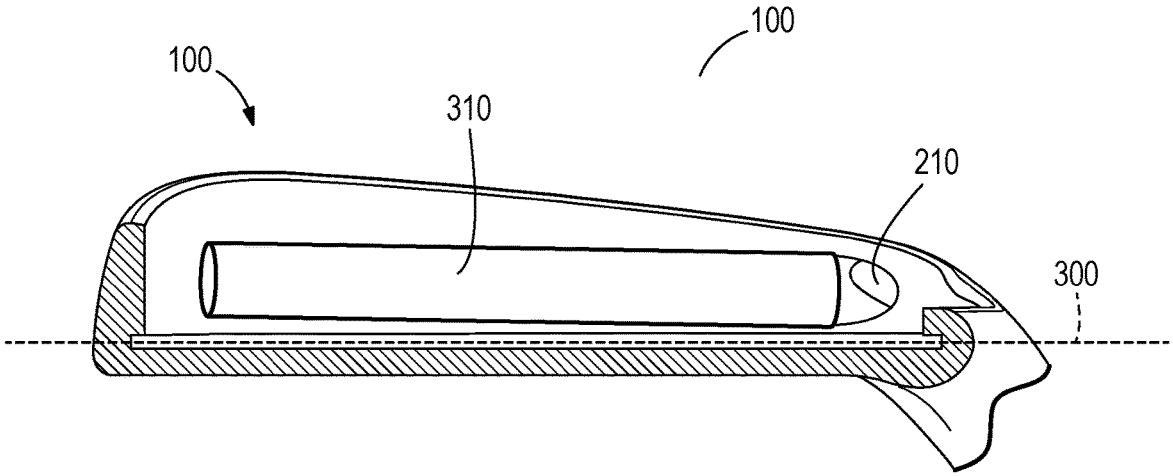
FIG. 3A illustrates the iron-type golf club head with a contact plane for an upper and lower forging die, and a billet of lightweight material.
Figure 3B:
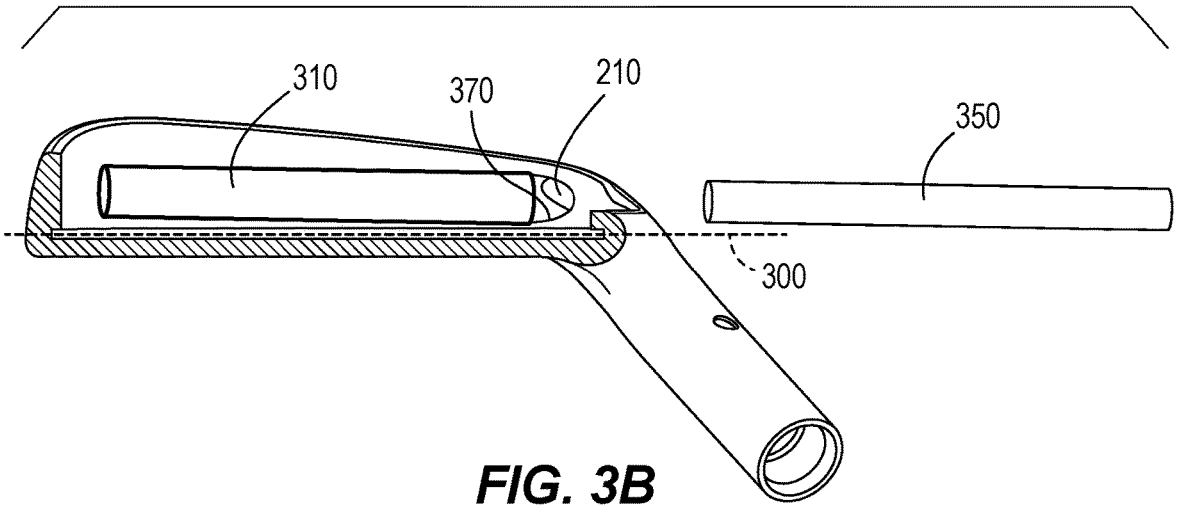
FIG. 3B illustrates the iron-type golf club head with a contact plane for an upper and lower forging die, and a billet of lightweight material along with a forging rod used to create a void in the lightweight material.

FIGS. 1, 2, and 4A-8 all refer to a single embodiment of the golf club head 100. All numbered features and elements are the golf club head 100 features and elements. FIGS. 3A and 3B also share these elements, but also have elements pertaining to the methods of manufacture.

Referring to FIG. 1, the club head 100 defines a ground plane 1000 that is tangent to the sole 150 when the club head 100 is at an address position.

Figure 4A:
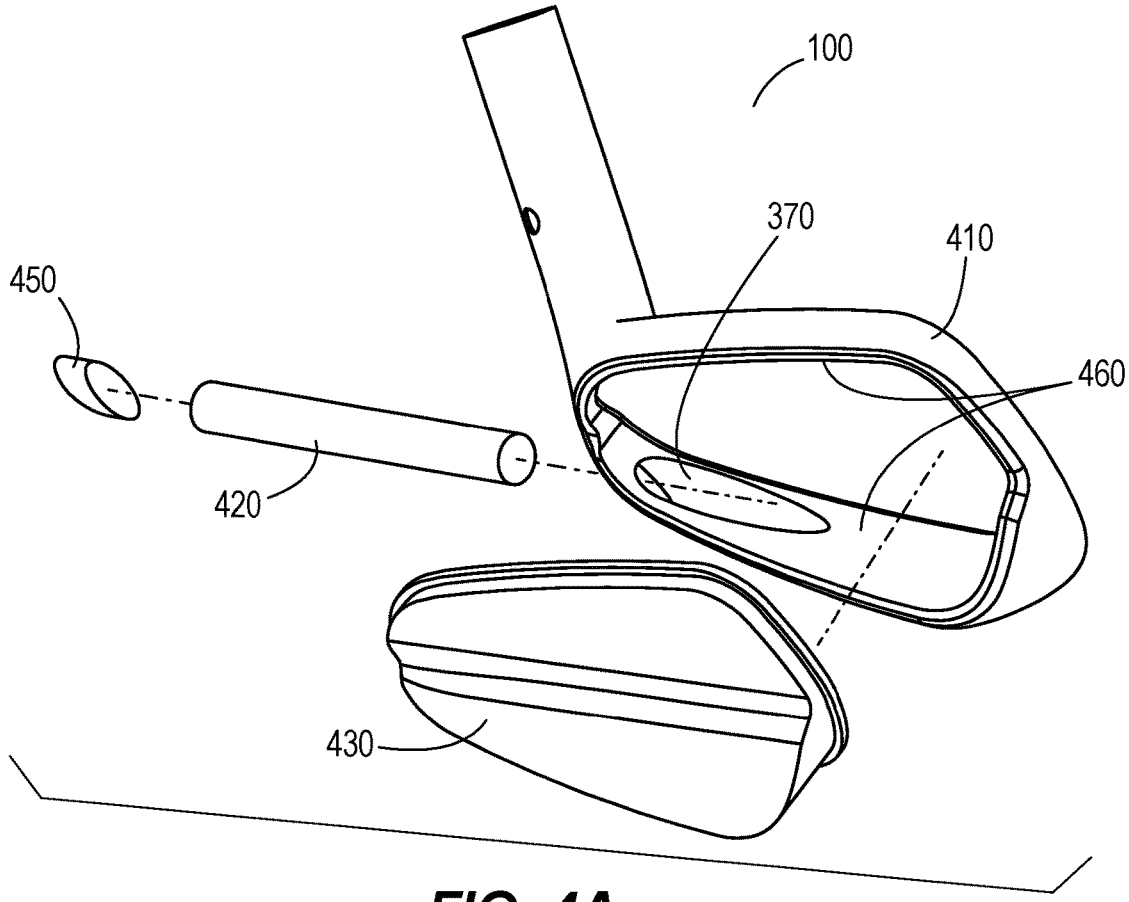
FIG. 4A illustrates the iron-type golf club head in an exploded view.

Referring to FIGS. 2 and 4A, the perimeter sidewall 460 is generally perpendicular to the rear surface 230. The perimeter sidewall 460 may vary from perpendicular by plus or minus 5 degrees. The heel end 130 of the golf club head 100 may have an aperture 210 through the heel end 130, so the aperture 210 opens to an exterior surface of the heel end 130 and opens to the back cavity 220.

Referring to FIGS. 2 and 4A, the perimeter sidewall 460 comprises a locking groove 240 in the perimeter sidewall 460 along the perimeter of the back cavity 220. The locking groove 240 is recessed into the perimeter sidewall 460 surrounding the rear surface 230. The locking groove 240 is recessed into the perimeter sidewall 460 in a direction parallel to the rear surface 230 of the striking face 140. (see FIG. 2)

Referring to FIG. 2, the locking groove 240 comprises a locking groove bottom and two locking groove sidewalls. The locking groove is open to the main body 410 back cavity 220 prior to the back cavity 220 receives the lightweight insert 430. The locking groove 240 can define a plane, wherein the plane intersects a center of the locking groove 240 bottom around the perimeter sidewall 460, and wherein the plane is essentially parallel to the striking face 140.

Still referring to FIG. 2, the locking groove 240 may have a single constant depth. In other embodiments, the depth of the locking groove 240 may vary. The locking groove 240 may have a single, constant width. In other embodiments, the locking groove 240 width may vary. The locking groove 240 may be continuous around the entire perimeter sidewall 460. The locking groove 240 may be discontinuous, and form multiple portions separated from one another around the perimeter sidewall 460. The locking groove 240 may comprise projections or depressions along the locking 240 bottom. The locking groove 240 sidewalls may comprise depressions or recesses in locking groove 240 sidewalls wherein the depressions or recessions are perpendicular to the locking wall sidewalls 240 (Figure not shown).

Still referring to FIG. 2, the locking groove 240 depth may be in the range of 0.1 inch to 0.5 inch. The locking groove 240 depth may be 0.1, inch 0.2 inch, 0.3 inch, 0.4 inch, or 0.5 inch. The locking groove 240 width may be in a range of 0.1 inch to 0.5 inch. The locking groove 240 width may be 0.1, inch 0.2-inch, 0.3 inch, 0.4 inch, or 0.5 inch.

Figure 4B:
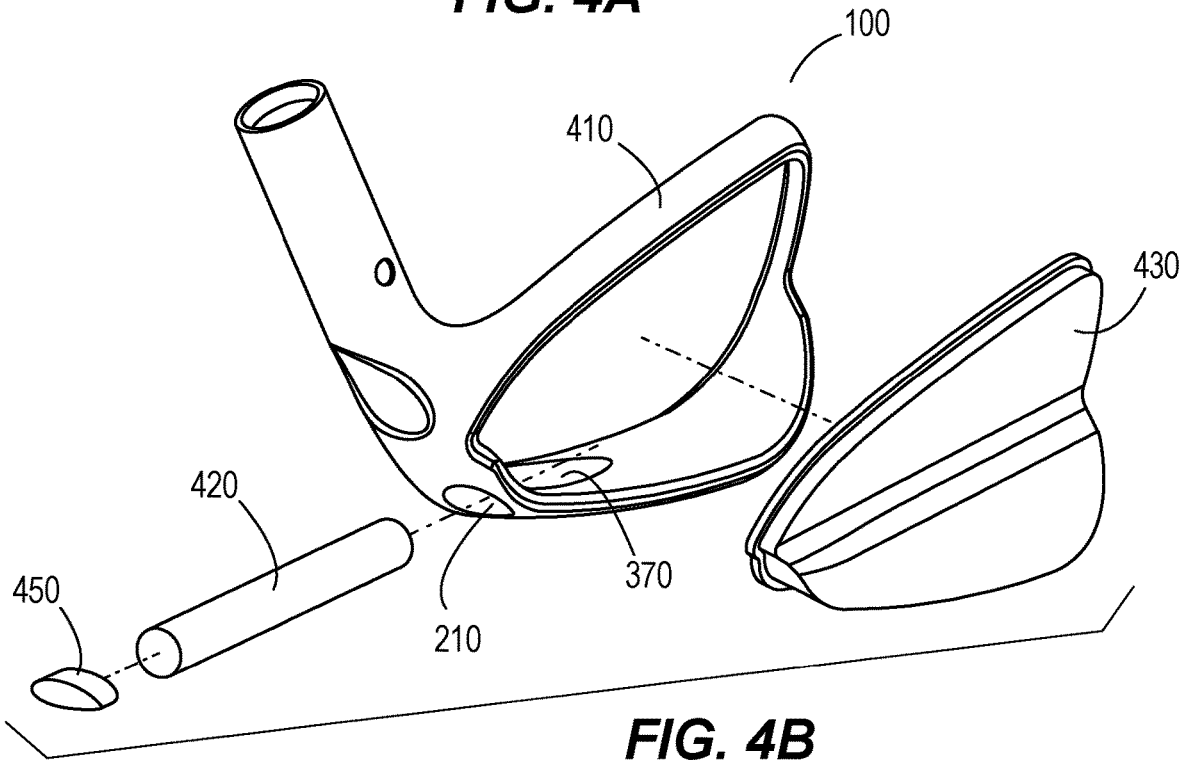
FIG. 4B illustrates the iron-type golf club head in an exploded view.
Figure 4C:
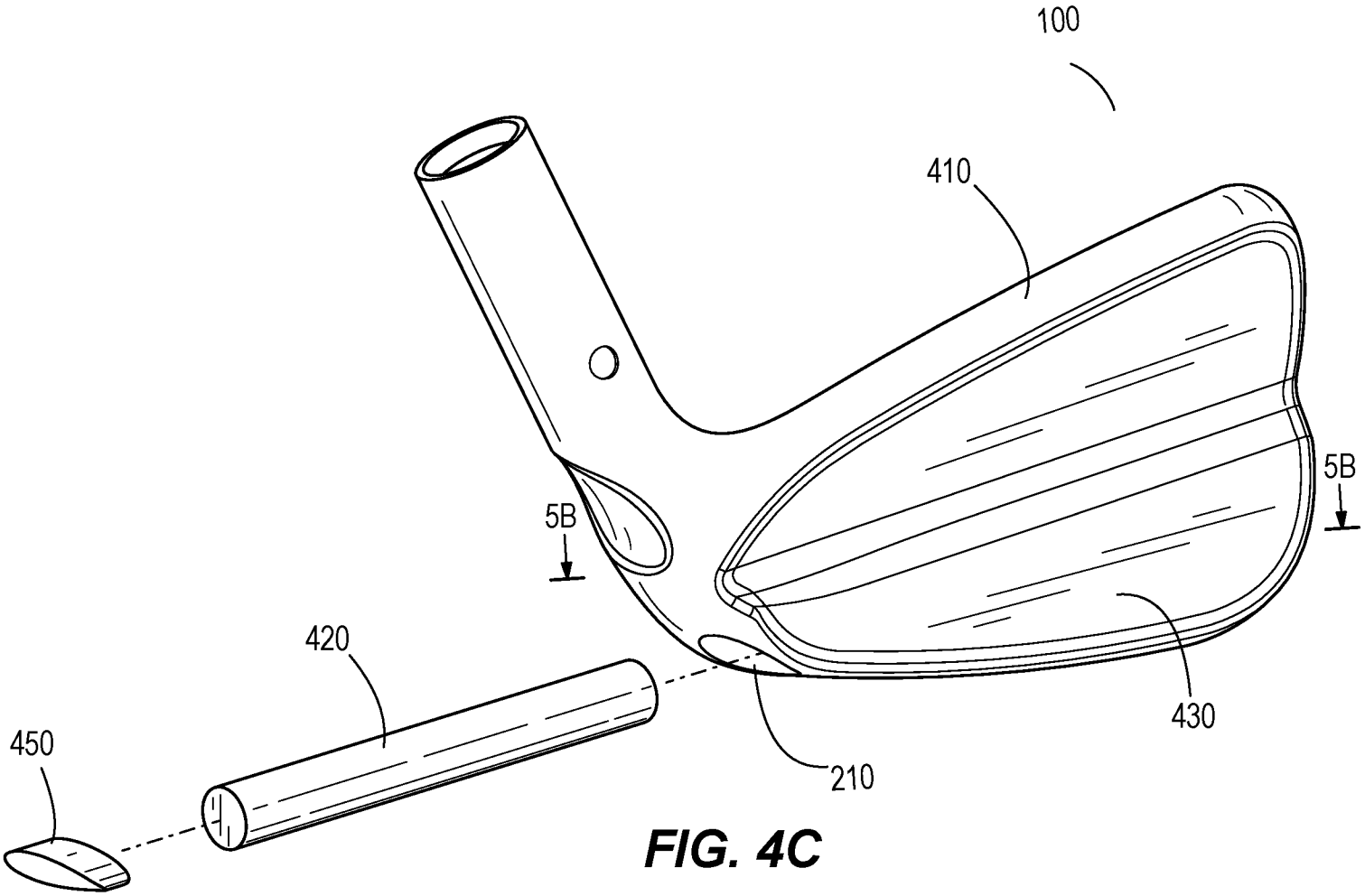
FIG. 4C illustrates the iron-type golf club head in an exploded view.

Referring to FIGS. 4A and 4B, the sole 150 further comprises a CTP weight groove 370. The CTP weight groove 370 comprises a CTP weight groove 370 axis along the length of the CTP weight groove 370 so the CTP weight groove 370 axis is equidistant from the CTP weight groove 370 edges along the length of the CTP weight groove 370 from the golf club head 100 heel end 130 to the golf club head 100 toe end 110. The CTP weight groove 370 axis is parallel to the rear surface 230 of the striking face 140. The central CTP weight groove 370 axis defines an angle with the ground plane 1000 when the golf club head is in an address position. The CTP weight groove 370 receives part of the length of the CTP weight 420 when the CTP weight 420 is received within the void 710.

Still referring to FIGS. 4A and 4B, the CTP weight groove 370 axis angle in relation to the ground plane 1000 when the golf club head 100 is at an address position may be between 0 degrees and 30 degrees. The CTP weight groove 370 axis angle may be 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 degrees.

Still referring to FIGS. 4A and 4B, the CTP weight groove 370 comprises a length, a width, and a depth of recession. The CTP weight groove 370 depth of recession is measured from and in relation to the surface of the surrounding sole 150 perimeter sidewall 460 so the CTP weight groove 370 defines a recess in the sole 150 perimeter sidewall 460. The CTP weight groove 370 depth of recession gradually decreases from closest to the golf club head 100 heel end 130 as it extends toward the golf club head toe end 110. The CTP weight groove 370 depth width gradually decreases from closest to the golf club head heel end 130 as it extends toward the golf club head toe end 110. The CTP weight 420 groove 370 tapers to a toe end 110 termination where the CTP weight groove 370 depth and CTP weight groove 370 width are each zero. The CTP weight groove 370 further comprises a cross-sectional profile. The CTP weight groove 370 cross-sectional profile may be constant. Alternately, the CTP weight groove 370 cross-sectional profile may gradually change from closest to the golf club head heel end 130 toward the golf club head toe end 110. The CTP weight groove 370 cross-sectional profile may decrease from closest to the golf club head heel end 130 toward the golf club head toe end 110. The CTP weight groove 370 cross-sectional profile may comprise a radius of curvature. The CTP weight groove 370 comprises edges along the points wherein the recession from the sole 150 perimeter sidewall 460 begins.

Referring to FIGS. 2 and 4B, the golf club head 100 main body 410 further defines a hole or aperture 210 in the heel end 130 of the golf club head 100 main body 410 that extends from an outer surface of the main body 410 into the back cavity 220. The aperture 210 comprises a depth and a cross-sectional area. The aperture 210 defines a central axis wherein the aperture 210 central axis extends along with the depth of the aperture 210 through a geometric center of the aperture 210 and essentially parallel the strikeface rear surface 230. In some embodiments, the aperture 210 comprises a circular cross-sectional shape having a radius of curvature. In other embodiments, the aperture 210 comprises any geometric cross-sectional shape. (See FIG. 2) The aperture 210 extends from the exterior surface of the heel end 130 of the golf club head main body 410 through the heel end 130 of the perimeter sidewall 460.

Still referring to FIGS. 2 and 4B, the central axis of the aperture 210 also extends parallel to the CTP weight groove 370 axis. In one embodiment, the cross-sectional shape of the aperture 210 in the heel end 130 of the golf club main body 410 can be circular, the cross-sectional shape of the CTP weight groove 370 can be a circular section at any location along the CTP weight groove 370 length, wherein the radius of curvature of the aperture 210 and the CTP weight groove 370 radius of curvature are the same.

The main body 410 of the golf club head 100 can comprise steel alloys, titanium alloys, aluminum alloys, plastic polymers, carbon fibers, composites, thermoplastic composites, or any other suitable material.

Lightweight Component

FIGS. 1-9 all refer to a single embodiment of the golf club head 100. All numbered features and elements are the golf club head 100 features and elements.

Referring to FIGS. 2 4A, 4B, and 4C, the lightweight component 430 resides in the back cavity 220 of the main body 410 and provides a clean muscle-back aesthetic. The lightweight component 430 comprises an upper portion 620, a lower, muscle-back portion 640, and a transition 630 between the upper portion 620 and the lower, muscle-back portion 640. The upper portion 620 does not extend further rearward than the main body 410 top-rail 120. The lower, muscle-back portion 640 does not extend further rearward than the main body 410 sole 150. The upper portion 620 comprises a first insert thickness. The lower, muscle-back portion 640 defines a second insert thickness. The second insert thickness may vary. The second insert thickness may have a maximum thickness between the sole portion of the perimeter sidewall 460 and the insert transition 630. The second insert thickness is larger than the first insert thickness. The insert transition 630 comprises a thickness that transitions from the first insert thickness to the second insert thickness.

Referring to FIGS. 2, 4A, 4B, 4C, 5A and 6, the lightweight component 430 comprises a locking flange 610 configured to be received within the locking groove 240 in the perimeter sidewall 460 of the back cavity 220, providing a mechanical lock to retain the lightweight component 430 within the back cavity 220. The lightweight component 430 encompasses a void 710 for retaining the CTP weight 420, such that the void 710 aligns with the heel aperture 210 in the main body 410. The aperture 210 in the main body 410 and the void 710 in the lightweight component 430 combine to receive the CTP weight 420. (FIG. 4C) The void 710 can be within the lower, muscle-back portion 640 of the lightweight component 430. No portion of void 710 is within the lightweight component 430 transition portion 630 or upper portion 620.

Figure 5A:
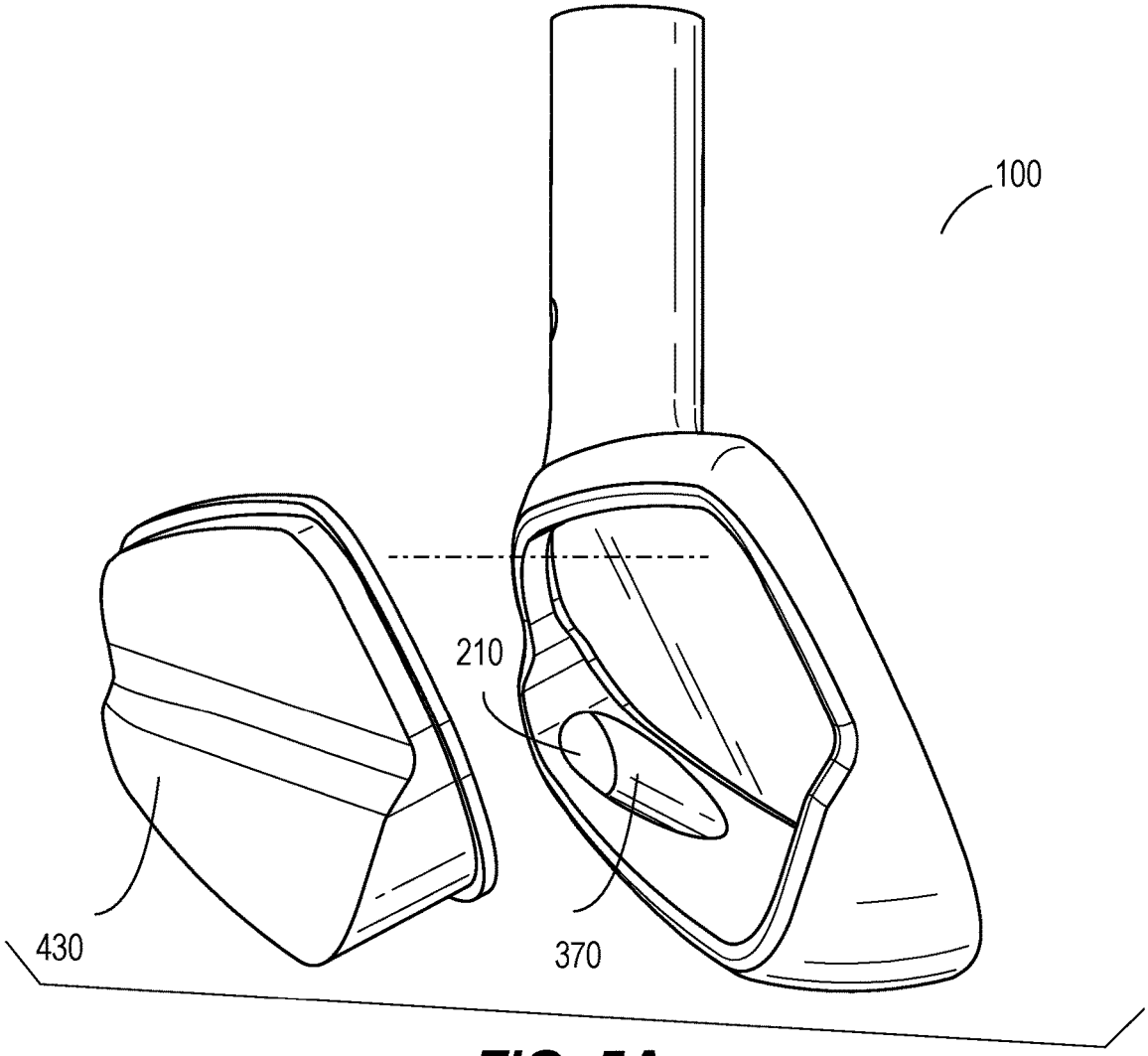
FIG. 5A illustrates the iron-type golf club head main club body and lightweight back cavity insert.
Figure 5B:
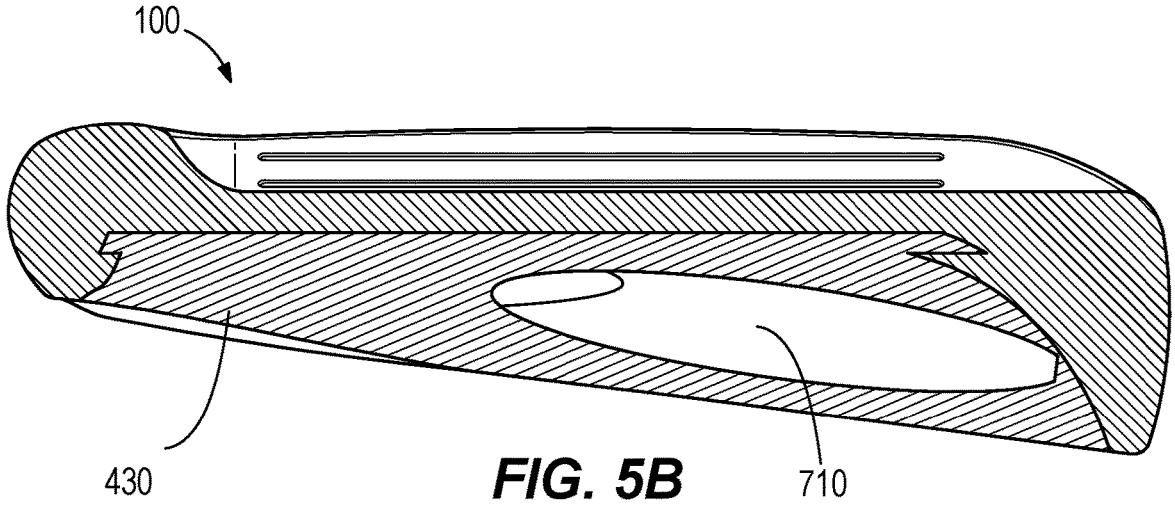
FIG. 5B illustrates a bottom cutaway view showing the void in the lightweight back cavity insert.
Figure 6:
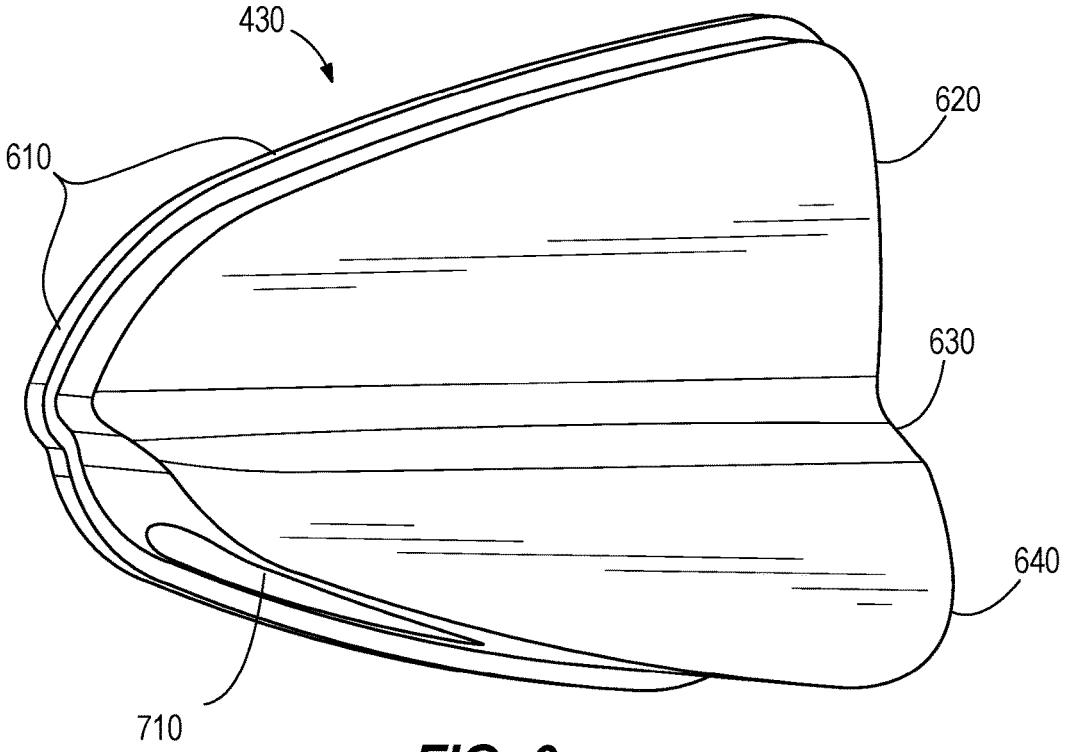
FIG. 6 illustrates the lightweight back cavity insert.
Figure 7A:
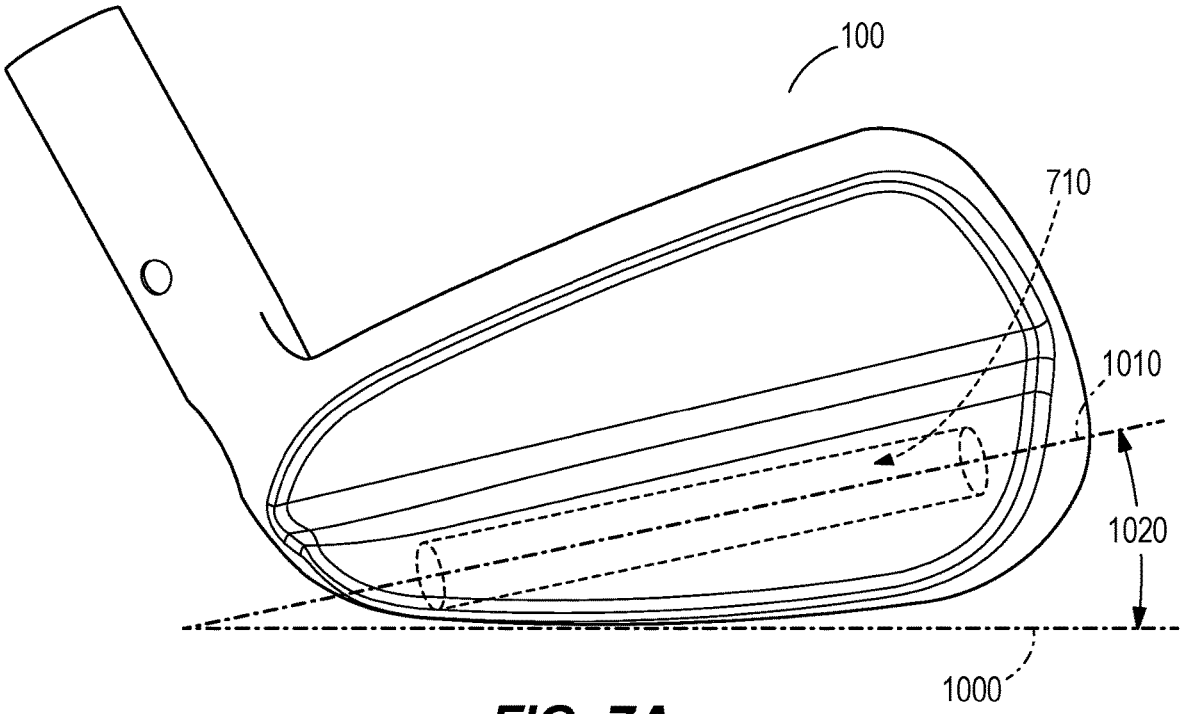
FIG. 7A illustrates the iron-type golf club head with a void in the lightweight back cavity insert.

Referring to FIGS. 5A, 5B, and 7A, the lightweight component 430 can surround a void 710 aligned to the aperture 210 in the heel end 130 of the golf club head 100. The void 710 has a length measured from the heel end 130 toward the toe end 110 parallel to the sole 150 and striking face 140 of the golf club head 100 along the CTP weight 420 groove axis. The void 710 has a diameter or cross-sectional width. The void 710 is open to the aperture 210 at the heel end 130 and closed towards the toe end 110 such that the void 710 does not extend entirely through the lightweight component 430. In many embodiments, the void 710 can be a tapered cylinder with a cross-sectional shape complementary to the shape of the heel aperture 210 of the main body 410. (FIG. 5A) The cross-sectional shape of the void 710 can be tapered, so the cross-section toward the toe-end 110 of the void 710 is smaller than the void 710 cross-section toward the main body 410 heel-end 130.

The void 710 length can be in a range of 2.0 inches to 4.0 inches. The void 710 length may be 2.0 inches, 2.5 inches, 3.0 inches, 3.5 inches, or 4.0 inches.

The void 710 diameter or cross-sectional width can be in a range of 0.25 inch to 0.75 inch. The void 710 diameter or cross-sectional width may be 0.25, 0.30, 0.35, 0.40, 0.45, 0.50, 0.55, 0.60, 0.65, 0.70, or 0.75 inch.

Figure 7B:
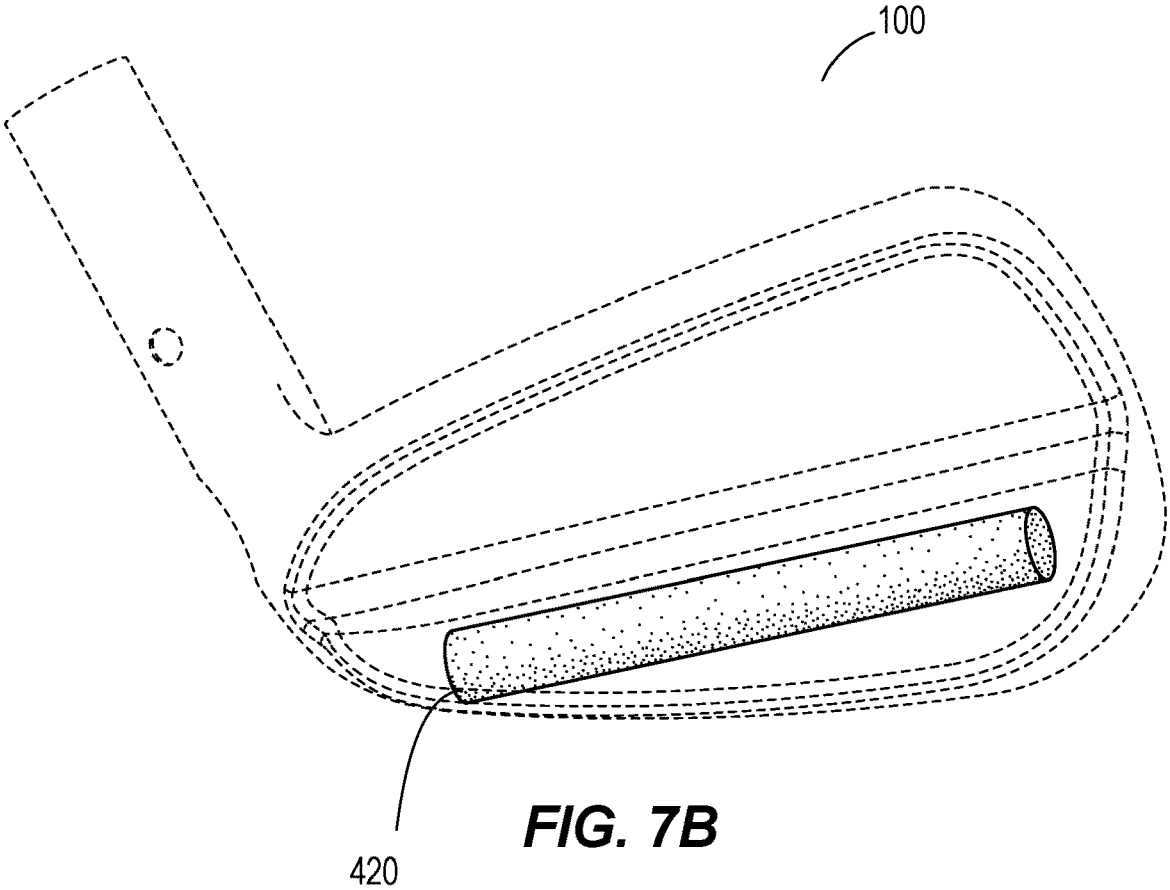
FIG. 7B illustrates the iron-type golf club head with a weight within the void.
Figure 8:
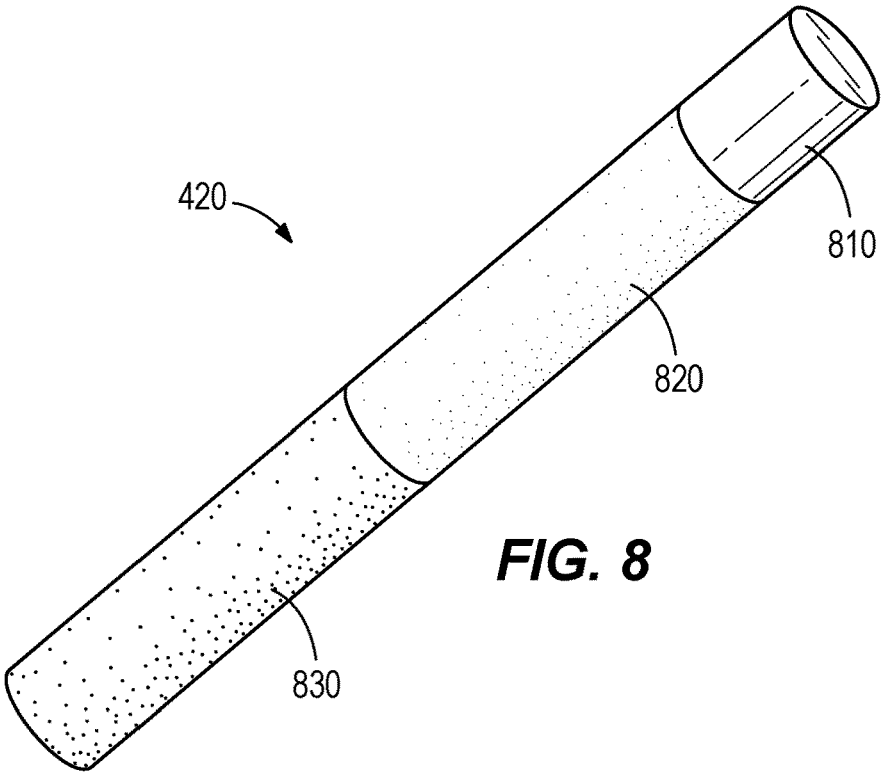
FIG. 8 illustrates a CTP weight.

Referring to FIG. 7, the void 710 defines a void central axis 1010. The void central axis 1010 is aligned with an aperture central axis. The void central axis 1010 is parallel to a CTP groove axis 370. The void central axis 1010 can be parallel with the golf club head strikeface 140. The void central axis 1010 also directly aligns with the aperture 210 central axis. The void central axis 1010 and aperture 210 central axis align because the void 710 aligns with the aperture 210 to receive the CTP weight 420 without any turns or hindrance into the void 710.

Alternately, the void central axis 1010 may form a −5 degree to +5 degree angle with the golf club head strikeface 140; wherein a negative angle indicates that a toe ward portion of the void central axis 1010 is angled toward the golf club head strikeface 140, and a positive angle indicates that a toeward portion of the void central axis 1010 is angled away from the golf club head strikeface 140.

Still referring to FIG. 7, the void central axis 1010 defines a void angle 1020 with the ground plane 1000 when the golf club is at an address position. The angle 1020 may be in a range of 0 degrees to 30 degrees.

Still referring to FIG. 7, the void central axis angle 1020 relative to the ground plane 1000 when the golf club is at address may be 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 degrees.

Still referring to FIG. 7, the void central axis angle 1020 angles toward the top-rail 120 and toe end 110 of the golf club head 100. The void 710 is configured to receive the CTP weight 420. When the CTP weight 420 is received within the void 710, the CTP weight 420 also angles toward the top-rail 120 and toe end 110 of the golf club head 100 so the weight toe end portion 810 is proximate the top-rail 120 and toe end 110 of the golf club head 100 because the orientation of the CTP weight 420 is determined by the orientation of the void 710.

The lightweight component 430 may comprise a metallic alloy having a second density that is less than the first density of the main body 410 of the iron-type golf club head 100. Alternately, the lightweight component 430 may comprise a thermoset or thermoplastic material. In still another embodiment, the lightweight component 430 may be formed of die casting or squeeze casting alloys such as an aluminum, manganese, magnesium, tin, or zinc alloy.

CTP Weight

FIGS. 1-9 all refer to a single embodiment of the golf club head 100. All numbered features are the golf club head 100 features.

The CTP weight 420 may add additional mass for the final swing-weight of the assembled club. The CTP weight 420 is positioned in the void 710 of the lightweight component 430. The CTP weight comprises a size and shape complementary to the void 710. The CTP weight 420 may be a tapered cylinder or some other tapered shape.

The CTP weight 420 can comprise steel alloys, titanium alloys, aluminum alloys, plastic polymers, carbon fibers, composites, thermoplastic composites, or any other suitable material The CTP weight 420 can comprise a mass between 1.0 g and 50.0 g. The CTP weight 420 may have a mass of 1.0, 2.0, 3.0, 4.0, 5.0, 6.0, 7.0, 8.0, 9.0, 10.0, 11.0, 12.0, 13.0, 14.0, 15.0, 16.0, 17.0, 18.0, 19.0, 20.0, 21.0, 22.0, 23.0, 24.0, 25.0, 26.0, 27.0, 28.0, 29.0, 30.0, 31.0, 32.0, 33.0, 34.0, 35.0, 36.0, 37.0, 38.0, 39.0, 40.0, 41.0, 42.0, 43.0, 44.0, 45.0, 46.0, 48.0, 49.0, or 50.0 grams.

The CTP weight 420 can be securely attached in the void 710 by adhesives, epoxy, welding, brazing, or any other suitable joining method. Alternately, the CTP weight may be press fit within the void 710 without the use of any permanent attachment method. In the alternate case, a first CTP weight 420 is interchangeable with another CTP weight or weights 420. The alternate CTP weight or weights 420 may have mass properties and material compositions different from the first CTP weight 420. A stopper or cap 450 is utilized to aesthetically cover the CTP weight 420 and to provide an additional mechanical lock to the CTP weight 420 (FIG. 4). Alternately, the stopper or cap 450 may be the primary means of retaining the CTP weight 420 within the void 720. In some embodiments, the stopper or cap 450 can be adhesively secured. In other embodiments, the stopper or cap 450 can be secured by any other attachment means such as threads, rivets, press-fit, etc.

In some embodiments, the CTP weight 420 can be comprised of at least two materials so the first CTP weight 420 material has a density less than the second CTP weight 420 material. The CTP weight 420 may have a center portion 820, a heel end portion 830, and a toe end portion 810. Either the CTP weight 420 toe end portion 810 or heel end portion 830 can comprise the second CTP weight 420 material. The higher density material at either the CTP weight 420 heel end or toe end shifts the golf club head center of gravity toward the golf club head heel end 130 or toe end 110.

Methods of Manufacture

In each embodiment, the golf club head comprises a main body with a back cavity. In each embodiment, a lightweight back cavity component, which further comprises an internal void, is placed within the back cavity. After placing the lightweight component into the back cavity, a CTP weight is placed within the lightweight component internal void through an aperture in the main body heel portion. A cap or stopper is then used to close the heel aperture and retain the CTP within the lightweight component void.

In one embodiment, the lightweight back cavity component may be press-fit in a back cavity by a forging operation to both fill the back cavity of the golf club head, and to appear a more traditional muscle back golf club head. In another embodiment, the lightweight back cavity component may be die-cast into the back cavity. In a third embodiment, the lightweight back cavity component may be injection molded from a polymer in one or more components and attached in the back cavity with an adhesive. Alternately, the lightweight back cavity component may be injection molded from a polymer directly into the back cavity. In each embodiment, the final golf club head further comprises

Forged Embodiment

In one embodiment the method of forming the golf club head 100, the forging process utilizes an upper die, a lower die, and a pull rod 350

The upper die comprises the negative shape of the lightweight component 430. The lower die comprises the negative shape of the main body 410 front. The pull rod 350 is sized to fit through the aperture 210 in the heel of the main body 410 and into the back cavity 220 (FIG. 3B). The pull rod 350 forms the size and shape of the void 710 in the lightweight component 430. The main body 410 may also have a CTP weight 420 groove in the lower portion of the rear cavity.

In this embodiment, using 3D forging beneficially enables a lightweight component 430 to be securely fastened to a golf club 100 main body 410 with a void 710 for placing a CTP weight 420. In typical forging applications, the final geometry of a part is very simplistic due to the limitations of the forging process, which would not allow for a void 710 to be produced. If a void 710 was desired in a typical forging application, a post-processing step such as machining would have to be used. Using the 3D forging process to create the void 710 is more cost-efficient than these alternative methods of producing the same feature. Using the lightweight component 430 can also enable inertia and center of gravity improvements for improved golf club 100 performance while maintaining an aesthetically pleasing muscle-back iron appearance.

Figure 9:
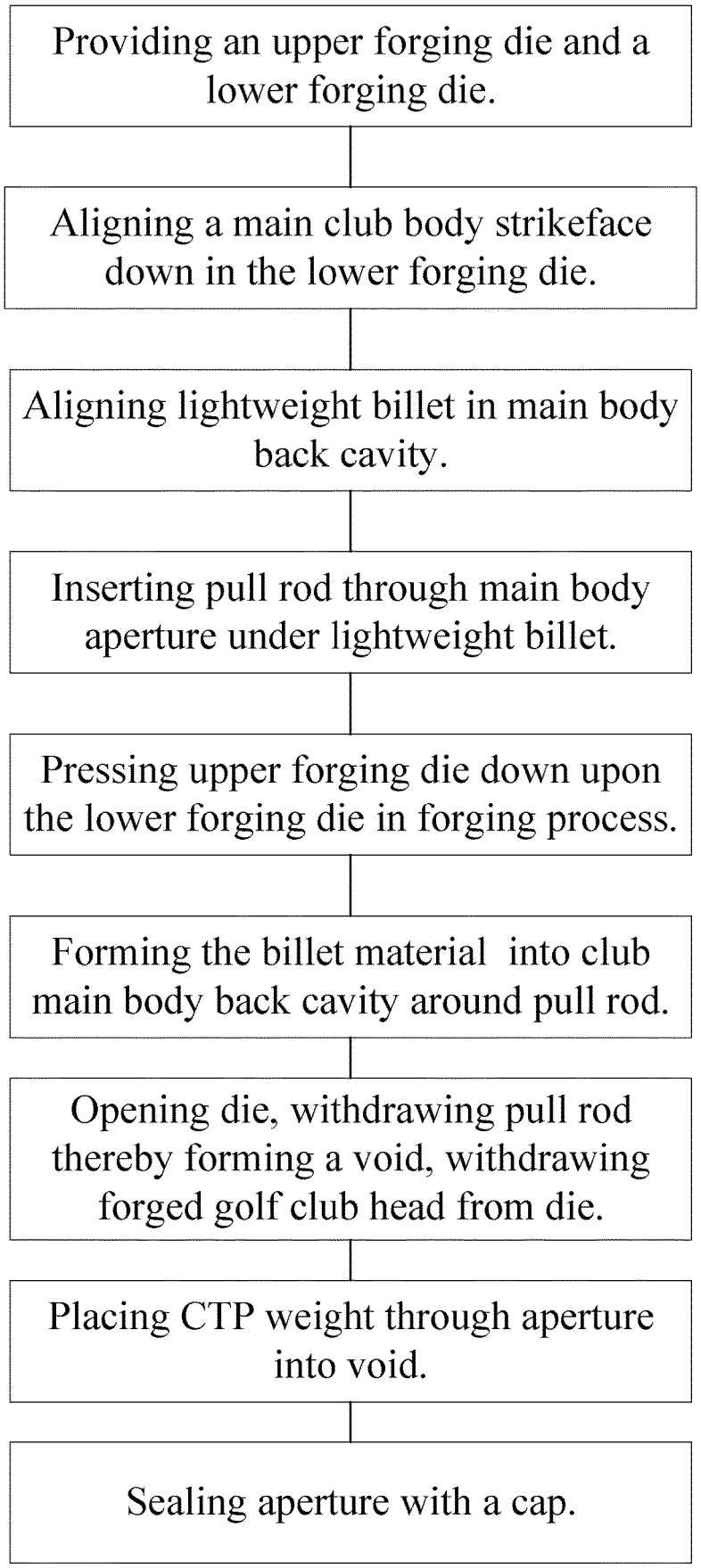
FIG. 9 illustrates a method to form a golf club head.

Referring to FIG. 9, in one embodiment the forging process for the lightweight component 430 comprises providing an upper, and lower forging die, wherein the upper die is configured to both receive the back portion of the main club body, and compress a billet of lightweight material to shape the muscle-back, lightweight back cavity insert; and wherein the lower die is configured to receive the main body strikeface down, placing the main body 410 into the lower forging die, orienting the back cavity 220 away from the lower forging die. (Referring to FIGS. 3A and 3B) Placing the lightweight billet 310 into the back cavity of the main body 410. Inserting the pull rod 350 through the aperture 210 in the heel of the main body 410 under the billet 310 and resting the pull rod 350 in the CTP groove 370, preventing the lightweight component 430 from filling the CTP groove 370 during the forging process. Placing the upper forging die over the back cavity 220 and billet 310, flush to the lower forging die at the plane of contact 300, compressing the lightweight billet 310. Applying heat and pressure during the forging/forming process to the part to deform the lightweight billet 310 to fill the back cavity 220 and locking groove 240 around the perimeter sidewall 460. Removing the upper forging die, lower forging die, and pull rod 350, wherein removing the pull rod 350 creates a void 710 in the lightweight component 430. Assembling the golf club head 100 by inserting the CTP weight 420 through the aperture 210 into the void 710, and thereafter sealing the aperture 210 with the cap or stopper 450.

Squeeze Cast Embodiment

Figure 10:
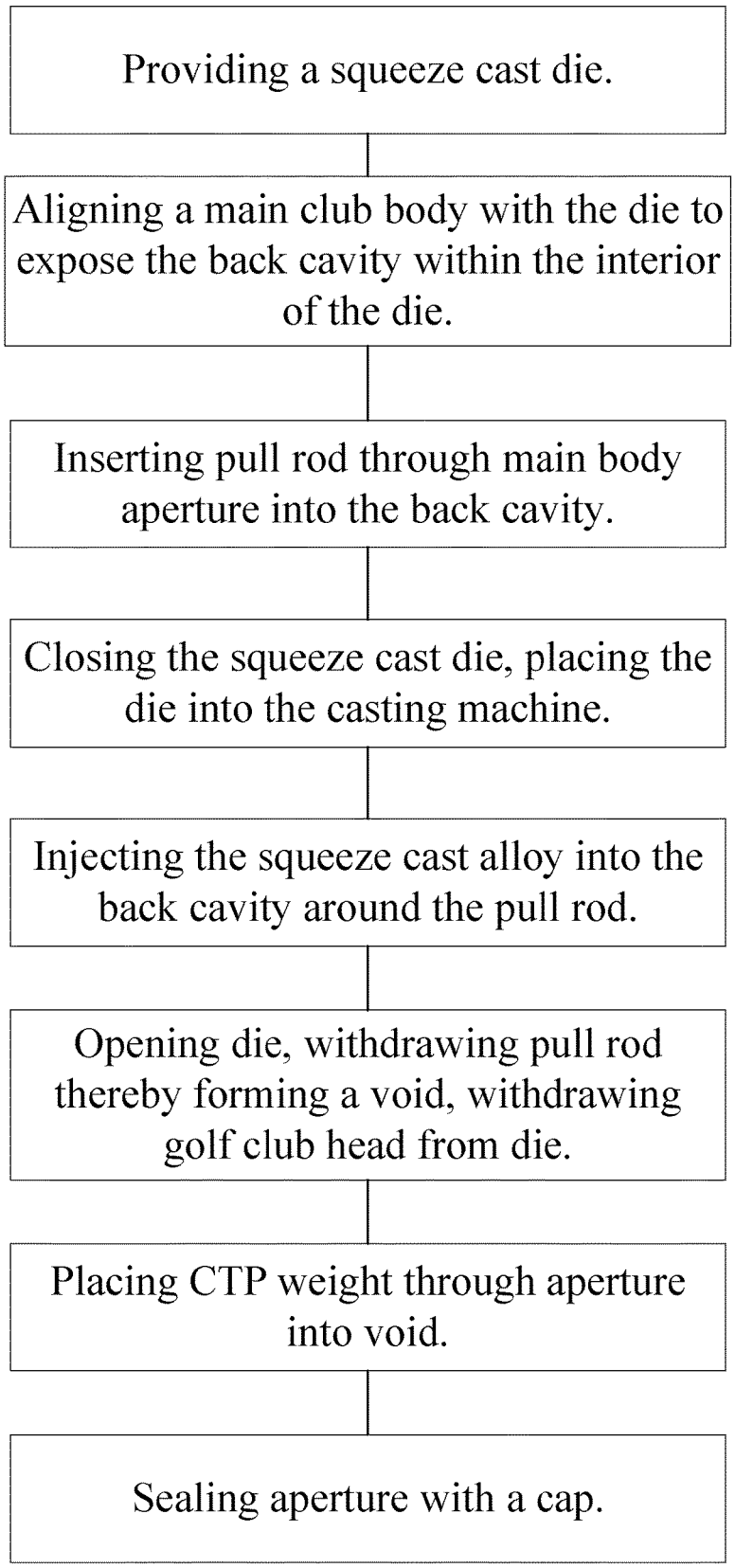
FIG. 10 illustrates a method to form a golf club head.

Referring to FIG. 10, a method to use squeeze or die casting to create a second embodiment of the golf club head 100 comprises providing a die or mold configured to receive the golf club main body 410; receiving the golf club main body 410 with the striking face 140 down and the main body 410 back cavity 220 exposed within the cavity of die or mold. Placing a pull rod 350 through the main body 410 heel aperture 210 resting in the sole 150 CTP groove 370 within the back cavity 220. Placing the die or mold into a die-cast or squeeze-cast apparatus, injecting molten or plastic lightweight material to fill the back cavity 220, shaping the lightweight insert component 430 within the back cavity 220. Opening the die or mold and withdrawing the golf club head 100, and then withdrawing the pull rod 350 out through the main body 410 heel aperture 210, wherein a void 710 is left within the lightweight back cavity 220 insert 430 formed by the die-cast or squeeze cast operation. Assembling the golf club head 100 by inserting the CTP weight 420 through the aperture 210 into the void 710, and thereafter sealing the aperture 210 with the cap or stopper 450.

Injection Molded Embodiment

Figure 11:
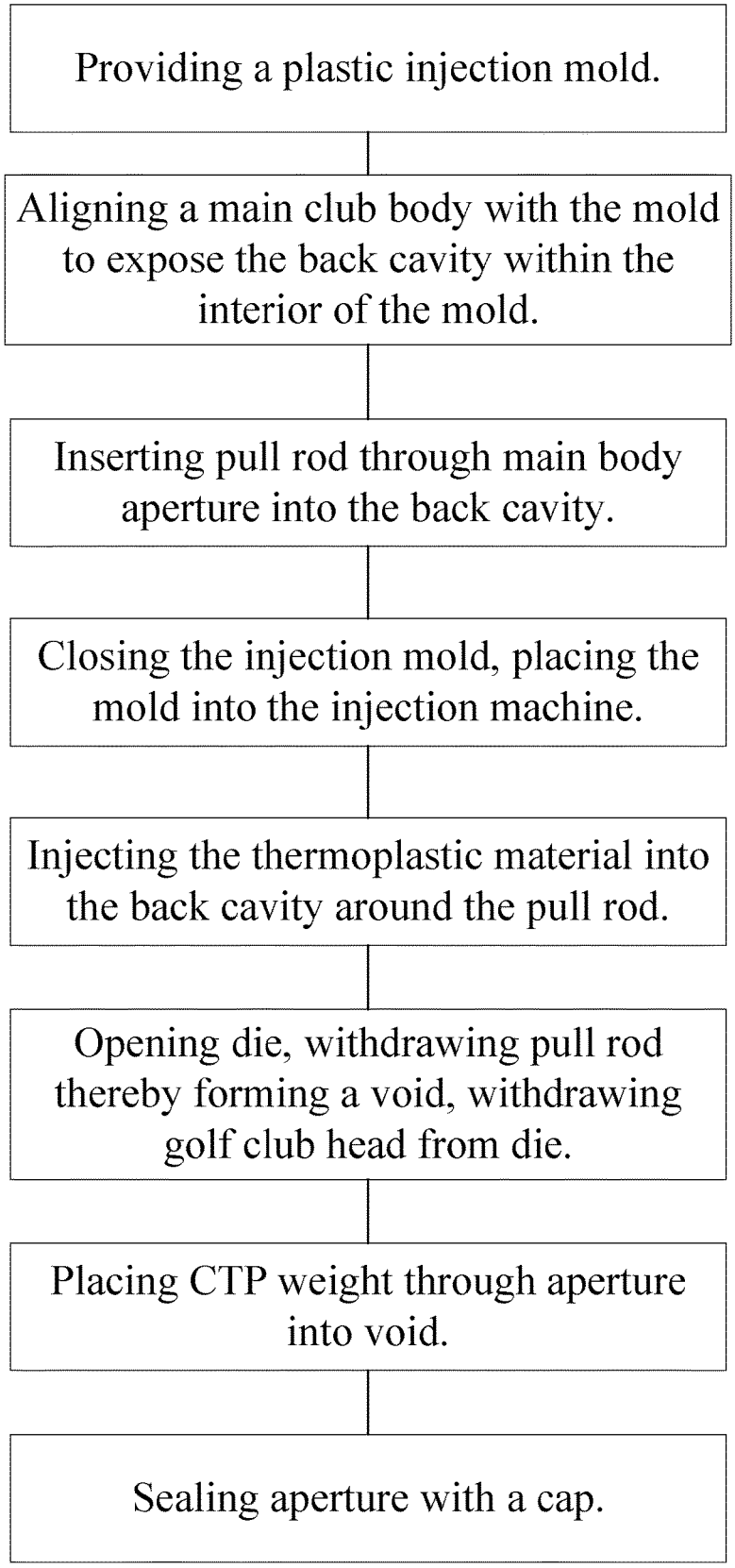
FIG. 11 illustrates a method to form a golf club head.

Referring to FIG. 11, a method to use injection molding to create a third embodiment of the golf club head 100 comprises providing an injection mold configured to receive the golf club main body 410; wherein injection mold is configured to receive the golf club main body 410 with the striking face 140 down and the main body 410 back cavity 220 exposed within a cavity of an injection mold. Placing a pull rod 350 through the main body 410 heel aperture 210 resting in the 150CTP groove 370 within the back cavity 220. Placing the injection mold into an injection molding apparatus, injecting polymeric, lightweight material to fill the back cavity 220 and shape the lightweight insert component 430 within the back cavity 220, opening injection mold to withdraw the golf club head 100, and then withdrawing the pull rod 350 out through the main body 410 heel aperture 210, wherein a void 710 is left within the lightweight back cavity 220 insert 430 formed by the injection molding operation.

As the rules to golf may change from time to time (e.g., new regulations may be adopted, or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Replacement of one or more claimed elements constitutes reconstruction and not repair. Additionally, benefits, other advantages, and solutions to problems have been described regarding specific embodiments. The benefits, advantages, solutions to problems, and any element or elements that may cause any benefit, advantage, or solution to occur or become more pronounced, however, are not to be construed as critical, required, or essential features or elements of any or all of the claims.

The above examples may be described in connection with a wood-type golf club, the apparatus, methods, and articles of manufacture described herein. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A method for forming an iron-type golf club head comprising:

providing a main club body, a lightweight insert, a cap, and a weight;

wherein the main club body comprises:

a front, a rear, a toe end, a heel end, a strikeface, a strikeface front surface configured to impact a golf ball, a hosel configured to receive a golf shaft, a top-rail, a sole, a strikeface rear surface, and a perimeter sidewall formed by the top rail, the sole, the toe end and the heel end;

wherein the perimeter sidewall extends rearwardly generally perpendicular to the strikeface;

wherein a back cavity is defined by the perimeter sidewall and the strikeface rear surface; and wherein the back cavity is open toward the rear of the main club body;

wherein the perimeter sidewall further comprises a locking groove recessed into the perimeter sidewall at least partially surrounding the strikeface rear surface;

wherein the locking groove is recessed into the perimeter sidewall in a direction parallel to the strikeface rear surface offset rearwardly from the strikeface rear surface;

wherein the main club body comprises an aperture in the heel end such that the aperture is a hole open to a heel end outer surface and also open to the back cavity;

wherein the main club body further comprises a first material having a first density;

wherein the first material comprises a first metallic alloy;

providing a forging die comprising an upper die platen and a lower die platen;

placing the main body within the forging die lower platen with the strikeface front surface oriented downwards and the back cavity is oriented upwards;

aligning a billet comprising a second material within the back cavity;

the second material having a second density lower than the first density;

inserting a pull rod through the aperture into the back cavity under the billet;

pressing the upper forging die platen down upon the lower forging die forming the lightweight insert;

lifting the upper forging die platen, and withdrawing the pull rod through the aperture forming a void within the lightweight insert;

receiving a weight within the void through the aperture;

sealing the aperture with the cap.

2. The method of claim 1, wherein an insert upper portion comprises a first insert thickness, and an insert muscle back portion comprises a second insert thickness;

wherein the second insert thickness is greater than the first insert thickness.

3. The method of claim 2, wherein the second insert thickness may vary.

4. The method of claim 2, wherein the void is contained entirely within the insert muscle back portion.

5. The method of claim 1, wherein the weight comprises a toe end portion, a center portion, and a heel end portion; and wherein the weight comprises a single material.

6. The method of claim 1, wherein the weight comprises a toe end portion, a center portion, and a heel end portion; and wherein the weight comprises a plurality of materials.

7. A method for forming an iron-type golf club head comprising:

providing a main club body, an insert, a cap, and a weight;

wherein the main club body comprises:

a front, a rear, a toe end, a heel end, a strikeface, a strikeface front surface configured to impact a golf ball, a hosel configured to receive a golf shaft, a top-rail, a sole, a strikeface rear surface, and a perimeter sidewall formed by the top rail, the sole, the toe end and the heel end;

wherein the perimeter sidewall extends rearwardly generally perpendicular to the strikeface;

wherein a back cavity is defined by the perimeter sidewall and the strikeface rear surface; and wherein the back cavity is open toward the rear of the main club body;

wherein the perimeter sidewall further comprises a locking groove recessed into the perimeter sidewall at least partially surrounding the strikeface rear surface;

wherein the locking groove is recessed into the perimeter sidewall in a direction parallel to the strikeface rear surface offset rearwardly from the strikeface rear surface;

wherein the main club body comprises an aperture in the heel end such that the aperture is a hole open to a heel end outer surface and also open to the back cavity;

wherein the main club body further comprises a first material having a first density;

wherein the first material comprises a first metallic alloy;

providing a squeeze casting mold;

placing the main club body within a squeeze casting mold such that the back cavity is exposed to an interior of the squeeze casting mold;

inserting a pull rod through the aperture into the back cavity;

heating a second metallic alloy material to a plastic temperature and forcing the second material into the squeeze casting mold to form a lightweight insert within the back cavity of the main club body;

wherein the second material having a second density lower than the first density;

opening the squeeze cast mold, and withdrawing the pull rod out through the aperture, thereby forming a void in the lightweight insert;

receiving a weight within the void through the aperture;

sealing the aperture with the cap.

8. The method of claim 1, wherein an insert upper portion comprises a first insert thickness, and an insert muscle back portion comprises a second insert thickness;

wherein the second insert thickness is greater than the first insert thickness.

9. The method of claim 8, wherein the second insert thickness may vary.

10. The method of claim 8, wherein the void is contained entirely within the insert muscle back portion.

11. The method of claim 7, wherein the weight comprises a toe end portion, a center portion, and a heel end portion; and wherein the weight comprises a single material.

12. The method of claim 7, wherein the weight comprises a toe end portion, a center portion, and a heel end portion; and wherein the weight comprises a plurality of materials.

13. A method for forming an iron-type golf club head comprising:

providing a main club body, an insert, a cap, and a weight;

wherein the main club body comprises:

a front, a rear, a toe end, a heel end, a strikeface, a strikeface front surface configured to impact a golf ball, a hosel configured to receive a golf shaft, a top-rail, a sole, a strikeface rear surface, and a perimeter sidewall formed by the top rail, the sole, the toe end and the heel end;

wherein the perimeter sidewall extends rearwardly generally perpendicular to the strikeface;

wherein a back cavity is defined by the perimeter sidewall and the strikeface rear surface; and wherein the back cavity is open toward the rear of the main club body;

wherein the perimeter sidewall further comprises a locking groove recessed into the perimeter sidewall at least partially surrounding the strikeface rear surface;

wherein the locking groove is recessed into the perimeter sidewall in a direction parallel to the strikeface rear surface offset rearwardly from the strikeface rear surface;

wherein the main club body comprises an aperture in the heel end such that the aperture is a hole open to a heel end out surface and also open to the back cavity;

wherein the main club body further comprises a first material having a first density;

wherein the first material comprises a first metallic alloy;

providing a plastic injection mold;

placing the main club body within a plastic injection mold such that the back cavity is exposed to an interior of the plastic injection mold;

inserting a pull rod through the aperture into the back cavity;

heating a thermoplastic material and forcing the thermoplastic material into the plastic injection mold to form a lightweight insert within the back cavity of the main club body;

opening the plastic injection mold, and withdrawing the pull rod out through the aperture, thereby forming a void in the lightweight insert;

receiving a weight within the void through the aperture;

sealing the aperture with the cap.

14. The method of claim 13, wherein an insert upper portion comprises a first insert thickness, and an insert muscle back portion comprises a second insert thickness;

wherein the second insert thickness is greater than the first insert thickness.

15. The method of claim 14, wherein the second insert thickness may vary.

16. The method of claim 14, wherein the void is contained entirely within the insert muscle back portion.

17. The method of claim 13, wherein the weight comprises a toe end portion, a center portion, and a heel end portion; and wherein the weight comprises a single material.

18. The method of claim 13, wherein the weight comprises a toe end portion, a center portion, and a heel end portion; and wherein the weight comprises a plurality of materials.

* * * * *